US006126410A

United States Patent [19]

Kung et al.

[11] Patent Number: 6,126,410

[45] Date of Patent: Oct. 3, 2000

[54] HEAD COVER ASSEMBLY FOR RECIPROCATING COMPRESSOR

[75] Inventors: Lin E. Kung; Steven C. Fairbanks; Edward T. Faulkner, all of St. Joseph, Mich.

[73] Assignee: Gast Manufacturing Corporation, Benton Harbor, Mich.

[21] Appl. No.: 09/022,907

[22] Filed: Feb. 12, 1998

[51] Int. Cl.[7] ..... F04B 39/00

[52] U.S. Cl. ..... 417/312; 417/533; 417/532; 417/571; 137/855

[58] Field of Search ..... 417/571, 312, 417/533, 540, 542; 137/855

[56] References Cited

U.S. PATENT DOCUMENTS

| | | |
|---|---|---|
| D. 245,779 | 9/1977 | Nobata . |
| D. 250,113 | 10/1978 | Nobata . |
| D. 379,996 | 6/1997 | Leu et al. . |
| 498,989 | 6/1893 | Perry . |
| 1,029,726 | 6/1912 | Sprado . |
| 1,636,001 | 7/1927 | Kasley . |
| 1,661,148 | 2/1928 | Winkler . |
| 1,672,436 | 6/1928 | Thege . |
| 1,896,098 | 2/1933 | Poyer . |
| 1,896,404 | 2/1933 | Hale . |
| 1,951,558 | 3/1934 | Nystrom . |
| 2,084,665 | 6/1937 | Aikman . |
| 2,127,825 | 8/1938 | Mader . |
| 2,134,077 | 10/1938 | Ehret . |
| 2,673,130 | 3/1954 | Becker . |
| 2,765,779 | 10/1956 | Graves . |
| 2,766,695 | 10/1956 | Gailloud . |
| 2,851,020 | 9/1958 | Dolza . |

(List continued on next page.)

FOREIGN PATENT DOCUMENTS

| | | |
|---|---|---|
| 2 323 035 | 11/1975 | France . |
| 101233 | 9/1896 | Germany . |
| 581380 | 7/1933 | Germany . |
| 844998 | 8/1960 | Germany . |
| 313250 | 12/1933 | Italy . |
| 406000 | 2/1934 | United Kingdom . |

OTHER PUBLICATIONS

Vacuum and Pressure Systems Handbook, revised Edition, Copyright 1986 by Gast Manufacturing Corporation, pp. 22 and 23.

Advertising literature: New Gast ROC–R Compressor.

Advertising literature: Gast Air Compressors, vol. F–10, date May, 1992, p. 41.

Advertising literature; Healy Systems, Inc., The New VP 500 Central Vacuum Vane Pump, Nov. 16, 1993.

Untitled drawing of pump, Models 607CB22 and 607CD22.

*Primary Examiner*—Timothy S. Thorpe
*Assistant Examiner*—Ehud Gartenberg
*Attorney, Agent, or Firm*—Barnes & Thornburg

[57] ABSTRACT

A head cover assembly for a compressor according to the present invention includes a valve plate mounted onto the compressor cylinder having a first side, a second side, a first bore, and a second bore, a first valve connected to the first side of the plate for controlling flow through the first bore, and a second valve connected to the second side of the plate for controlling flow through the second bore. The first and second valves are attached substantially adjacent the center of the plate using a single fastener. A cover is mounted onto the second side of the valve plate. The cover includes a continuous side wall which surrounds the first and second bores, an enclosure wall extending between the top edge of the side wall thereby enclosing a volume above the valve plate, and a divider wall which extends between the side wall through the enclosed volume to define an intake volume and an exhaust volume. The divider wall encloses the second bore and second valve within the exhaust volume and the first bore within the intake volume. Gas is drawn into the intake volume through an inlet port in the cover side wall, and into the cylinder through the first bore. Gas is forced out of the cylinder through the second bore, and out of the exhaust volume through an exhaust port in the cover side wall.

30 Claims, 11 Drawing Sheets

U.S. PATENT DOCUMENTS

| | | |
|---|---|---|
| 2,879,913 | 3/1959 | McCombie . |
| 2,970,608 | 2/1961 | Doeg . |
| 2,976,813 | 3/1961 | Redman . |
| 2,985,358 | 5/1961 | Lee et al. . |
| 3,049,284 | 8/1962 | Alamprese . |
| 3,082,935 | 3/1963 | Arak . |
| 3,139,009 | 6/1964 | Härting . |
| 3,160,229 | 12/1964 | Terasawa . |
| 3,209,659 | 10/1965 | Colwell . |
| 3,277,837 | 10/1966 | Pangburn . |
| 3,315,651 | 4/1967 | Dangauthier . |
| 3,375,972 | 4/1968 | Raufeisen . |
| 3,386,424 | 6/1968 | Appeman . |
| 3,432,177 | 3/1969 | Colwell . |
| 3,468,260 | 9/1969 | Belden . |
| 3,472,446 | 10/1969 | Linnert . |
| 3,521,607 | 7/1970 | Wiseman et al. . |
| 3,526,469 | 9/1970 | Lipe et al. . |
| 3,568,573 | 3/1971 | Bailey et al. . |
| 3,612,726 | 10/1971 | Yowell . |
| 3,628,427 | 12/1971 | Bailey . |
| 3,718,410 | 2/1973 | Berger et al. . |
| 3,841,796 | 10/1974 | Schlanzky . |
| 3,882,842 | 5/1975 | Bailey et al. . |
| 3,927,956 | 12/1975 | Linthicum . |
| 3,961,868 | 6/1976 | Droege, Sr. et al. . |
| 3,961,869 | 6/1976 | Droege, Sr. et al. . |
| 3,981,631 | 9/1976 | Kemp . |
| 3,998,571 | 12/1976 | Falke . |
| 4,088,428 | 5/1978 | Bannister et al. . |
| 4,123,201 | 10/1978 | Andriulis . |
| 4,275,999 | 6/1981 | Hetzel et al. . |
| 4,311,440 | 1/1982 | Eberhardt . |
| 4,406,590 | 9/1983 | Kessler . |
| 4,433,966 | 2/1984 | Krumm . |
| 4,434,448 | 2/1984 | Bell et al. . |
| 4,477,231 | 10/1984 | Swift . |
| 4,480,368 | 11/1984 | Vachon . |
| 4,559,686 | 12/1985 | Kessler . |
| 4,594,760 | 6/1986 | Dillard . |
| 4,642,037 | 2/1987 | Fritchman . |
| 4,718,827 | 1/1988 | Sutton et al. . |
| 4,749,340 | 6/1988 | Ikeda et al. . |
| 4,781,540 | 11/1988 | Ikeda et al. . |
| 4,782,738 | 11/1988 | Jackson et al. . |
| 4,790,727 | 12/1988 | Steele . |
| 4,810,174 | 3/1989 | Stuckey et al. . |
| 4,842,498 | 6/1989 | Bramstedt et al. . |
| 4,867,650 | 9/1989 | Ikeda et al. . |
| 4,911,614 | 3/1990 | Kawai et al. . |
| 4,976,284 | 12/1990 | Hovarter . |
| 5,064,359 | 11/1991 | Plummer . |
| 5,096,395 | 3/1992 | Todescate et al. . |
| 5,145,335 | 9/1992 | Abelen et al. . |
| 5,147,190 | 9/1992 | Hovarter . |
| 5,156,532 | 10/1992 | Arndt et al. . |
| 5,226,803 | 7/1993 | Martin . |
| 5,231,917 | 8/1993 | Wood . |
| 5,288,212 | 2/1994 | Lee . |
| 5,328,338 | 7/1994 | Hirano et al. . |
| 5,370,156 | 12/1994 | Peracchio et al. . |
| 5,379,799 | 1/1995 | Kawai et al. . |
| 5,390,633 | 2/1995 | Taue . |
| 5,396,930 | 3/1995 | Ebbing et al. . |
| 5,421,368 | 6/1995 | Maalouf et al. . |
| 5,454,397 | 10/1995 | Miszczak . |
| 5,586,874 | 12/1996 | Hashimoto et al. . |
| 5,601,118 | 2/1997 | Jang . |
| 5,603,611 | 2/1997 | Tarutani et al. . |
| 5,632,607 | 5/1997 | Popescu et al. . |
| 5,632,609 | 5/1997 | Hashimoto . |
| 5,647,395 | 7/1997 | Hashimoto et al. . |

HEAD COVER ASSEMBLY FOR RECIPROCATING COMPRESSOR

FIELD OF THE INVENTION

This invention relates generally to a head cover assembly for compressors.

BACKGROUND OF THE INVENTION

Reciprocating compressors generally include at least one piston which reciprocates within a cylinder. The gas or air is valved into and out of the compressor cylinder from an enclosed intake volume in communication with the compressor inlet, to an enclosed exhaust volume in communication with the compressor outlet. In many compressor applications, for example, oxygen concentrators which must be located near the user during operation, it is desirable to minimize the noise produced by the compressor. According to principles commonly known in the art, the larger the intake volume of the compressor, the lower the noise generated by the operation of the compressor.

SUMMARY OF THE INVENTION

The present invention provides a head cover assembly for a two cylinder compressor including a pair of valve plates mounted over the compressor cylinders. A head cover including two substantially identical enclosures is mounted over the valve plates, thereby enclosing a volume above each plate. Each cylinder cover includes a divider wall which divides the enclosed volume of the cover into an intake volume and an exhaust volume. The exhaust volumes of each intake cover are in communication with one another through a passageway in the center portion of the head cover connecting the two cylinder covers. The intake volumes are similarly communicated through a passageway in the center portion. The inlet volume enclosed by each cylinder cover is in communication with an inlet port for drawing air into the compressor. The exhaust volume of each cylinder cover is in communication with an exhaust port for expelling air from the compressor.

Each valve plate includes a first side, a second side, a first bore, and a second bore. A first valve is connected to the first side of the valve plate for controlling flow into the cylinder through the first bore, and a second valve is connected to the second side of the valve plate for controlling flow out of the cylinder through the second bore. The first and second valves are attached adjacent the center of the plate using a single fastener.

As the piston travels through its downstroke, air is drawn into the inlet volume through the inlet port, and into the cylinder through the second valve. As the piston travels through its upstroke, air within the cylinder is passed through the second valve and into the exhaust volume. The air passes from the exhaust volume out of the head cover assembly through the exhaust port. The divider wall of each cylinder cover is shaped so as to enclose the second valve within the exhaust volume, while maximizing the intake volume without interfering with the operation of the exhaust port.

Other features of the present invention will become apparent upon consideration of the following description of exemplary embodiments and the accompanying drawings.

DESCRIPTION OF EMBODIMENTS OF THE INVENTION

The embodiments described herein are not intended to be exhaustive or to limit the invention to the precise forms disclosed.

Figure 1:
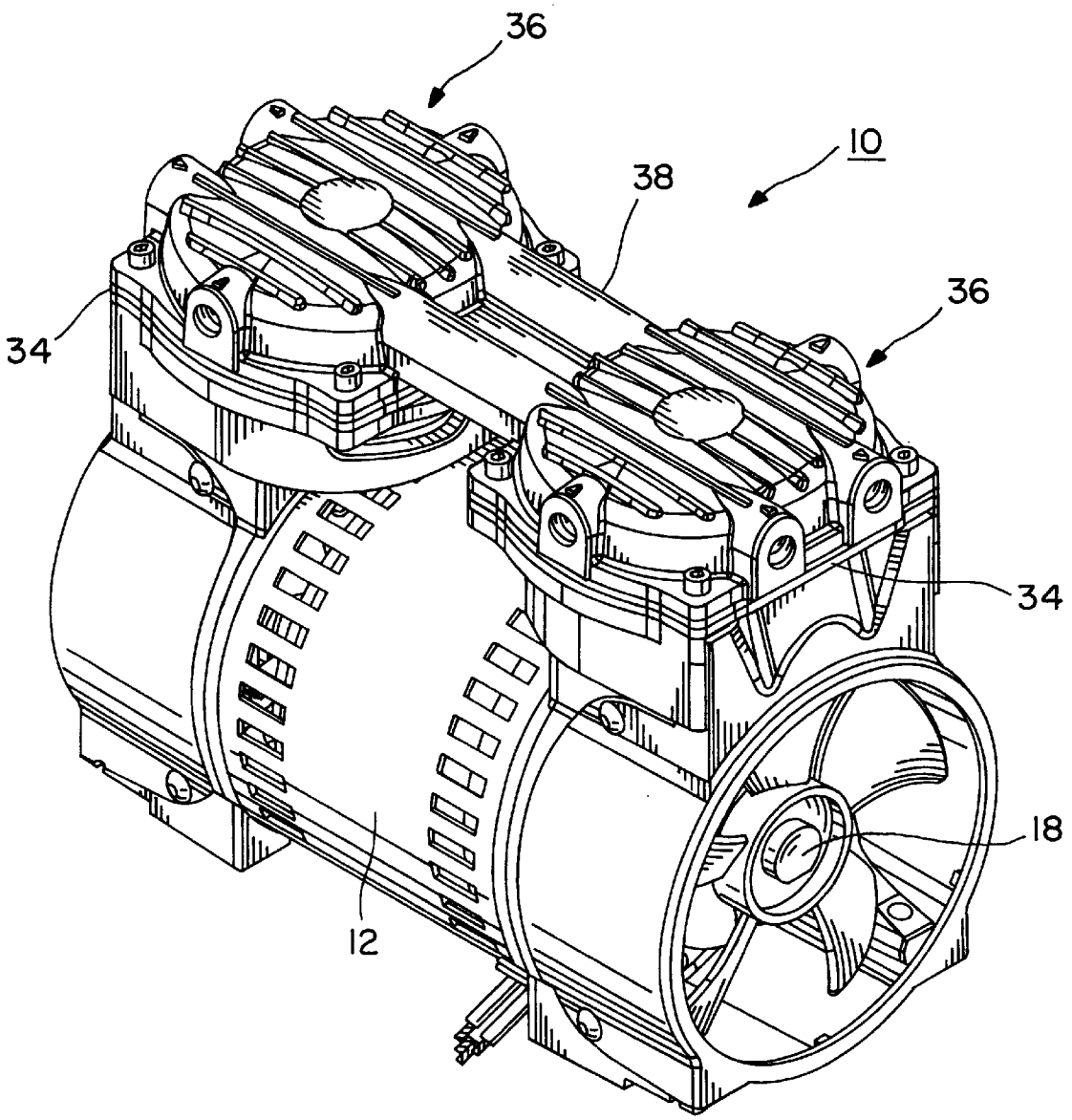
FIG. 1 is a perspective view of a head cover assembly according to the present invention mounted to a compressor.

FIG. 1 shows a head cover assembly 10 according to the present invention mounted to a compressor 12. Compressor 12 may be of various, conventional configurations having at least one cylinder. Compressor 12 of FIG. 1 is a dual cylinder configuration, each cylinder having substantially identical structure and performing a substantially identical function. Head cover assembly 10 similarly includes two substantially identical halves, each including a valve plate 34 and a cylinder cover 36. Thus, except where indicated, for example, in the description of the center portion 38 which connects the cylinder covers 36, the remainder of this description will address only the structure and function of one half of head cover assembly 10.

Compressor 12 includes a drive shaft 18 which rotates under the influence of a motor (not shown). Rotation of shaft 18 causes rectilinear movement of the pistons within the cylinders of compressor 12. Referring now to FIGS. 2–5, piston 14, which reciprocates within cylinder 16, generally includes a head 20, a rod 22, and an outer ring 24, all of which are formed as a unitary piece. Outer ring 24 of piston 14 is concentric with bearing 25 and inner ring 26. Bearing 25 is fixedly attached to the inner edge of outer ring 24 and rotates freely on the outer edge of inner ring 26. Inner ring 26 is fixedly connected to the compressor shaft 18 and a counter weight 28. The cross-section of shaft 18 and inner ring 26 are eccentric. As such, as shaft 18 rotates, carrying with it inner ring 26 and counter weight 28, piston 14, riding on bearing 25, reciprocates upwardly and downwardly within cylinder 16. At all positions except the top dead center position (FIG. 3) and the bottom dead center position (FIG. 5), piston head 20 is at a tilted or angled orientation relative to cylinder 16 due to the eccentricity of shaft 18 and inner ring 26. As should be apparent from the figures, because of the rocking motion of the piston, the portion of the piston which remains the farthest from the valve plate 34 is a line across the center of the upper surface 21 of head 20 passing into the page, parallel with shaft 18. Upper surface 21 of piston head 20 is bowed or convex, curving slightly downwardly with distance toward the ends 23 and 27 of head 20. The shape of upper surface 21 provides additional clearance between head 20 and valve plate 34 to accommodate the above-described rocking motion.

A flexible ring 30 is carried on the perimeter of piston head 20. Flexible ring 30 has an outward bias relative to piston head 20 such that it compressively engages the inner wall 32 of cylinder 16 throughout the piston's stroke, thereby preventing gas from escaping from the upper portion of the cylinder between the piston head 20 and the inner wall 32. The volume of gas displaced as piston 14 travels from bottom dead center to top dead center is commonly referred to as the swept volume of the piston.

Figure 6:
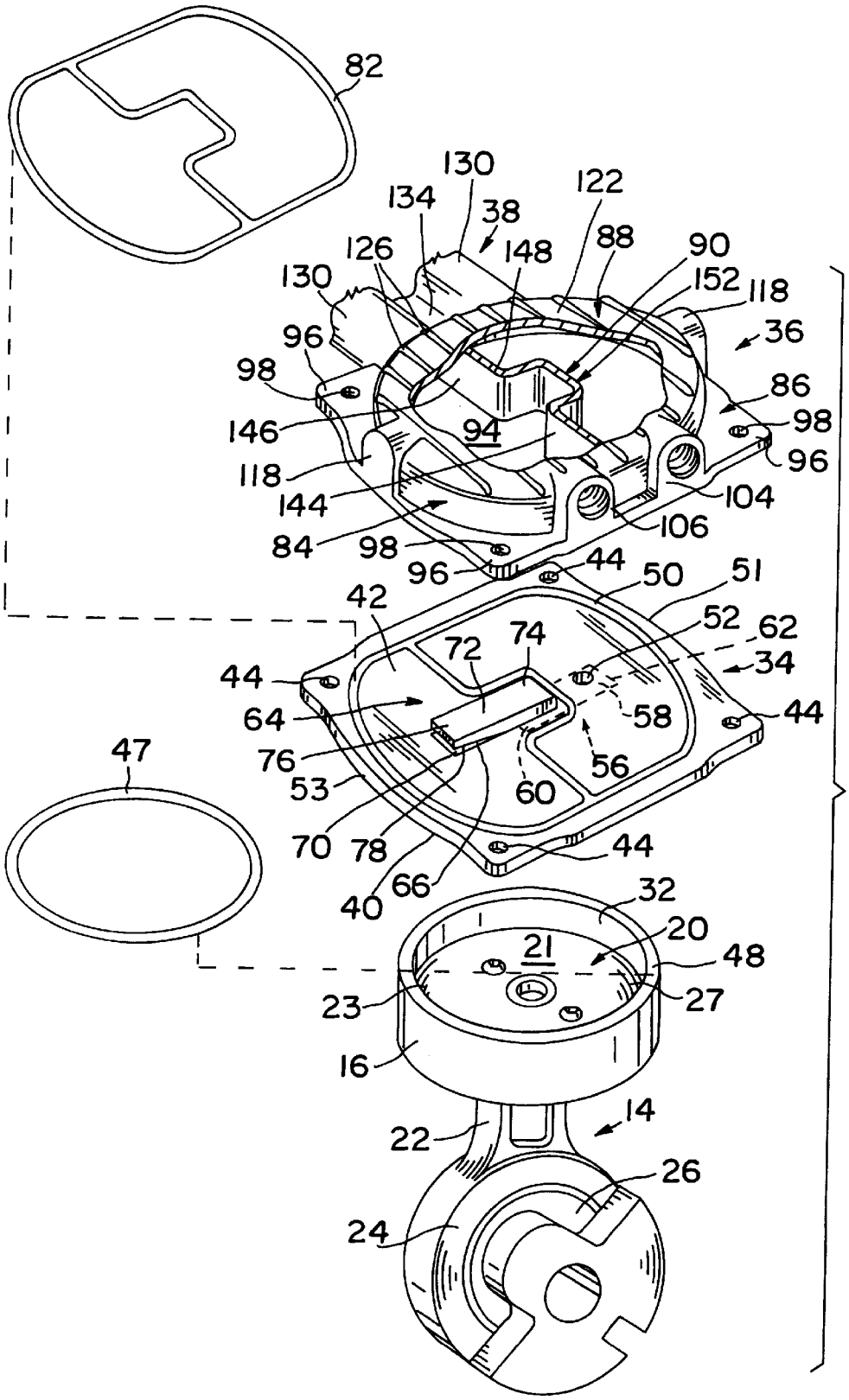
FIG. 6 is a partial, exploded, perspective view of a head cover assembly according to the present invention with portions cut away.

FIG. 6 shows one-half of head cover assembly 10 of the present invention, disassembled from the piston and cylinder assembly described above. Head cover assembly 10 generally includes a pair of valve plates 34 and a pair of cylinder covers 36 connected by a center portion 38. Each valve plate 34 is a flat, substantially rectangular plate having a first side 40 directed toward the cylinder 16 and a second side 42 directed toward cylinder cover 36. First side 40 includes a circular groove 46, shown in section in FIGS. 2–5, for receiving a gasket 47 which engages the upper edge 48 of cylinder 16. Second side 42 includes a groove 50 formed to mate with portions of cover 36 as described below. A compressible gasket 82 is inserted within groove 50. Gasket 82 is sized such that a cross-sectional portion of the gasket fits within groove 50 and another cross-sectional portion protrudes from groove 50 above the surface of second side 42 as best shown in FIGS. 2–5. When cover 36 is mounted onto valve plate 34, cover 36 compresses gasket 82, thereby providing a seal between cover 36 and valve plate 34 along the length of gasket 82. A plurality of holes 44 are provided adjacent the corners of plate 34 to facilitate mounting the plate to compressor 12.

Referring now to FIGS. 2–7, a first bore 52 extends through plate 34 adjacent one edge 51 of the plate and a second bore 54 extends through plate 34 adjacent the other edge 53. A first valve 56 (shown in dotted lines in FIGS. 6 and 7) is mounted to first side 40 of valve plate 34. First valve 56 includes a flexible sheet 58 having one end 60 fixedly attached to first side 40, captured between a retainer plate 61 and first side 40, and another, free end 62 which extends over and substantially covers first bore 52. A second valve, generally designated 64, is attached to second side 42 of valve plate 34. Second valve 64 also includes a flexible sheet 66 having one end 68 fixedly attached to second side 42 of plate 34, and another, free end 70 which extends over and substantially covers second bore 54. Second valve 64 further includes a valve limiter 72 which has one end 74 fixedly attached to valve plate 34 and another end 76. Flexible sheet 66 is captured between valve limiter 72 and second side 42 of valve plate 34. Limiter 72 includes an inclined or curved surface 78 which diverges from second side 42 with distance from one end 74. Accordingly, as flexible sheet 66 flexes away from second side 42, surface 78 engages sheet 66 to limit the distance away from second side 42 that flexible sheet 66 may travel.

Figure 7:
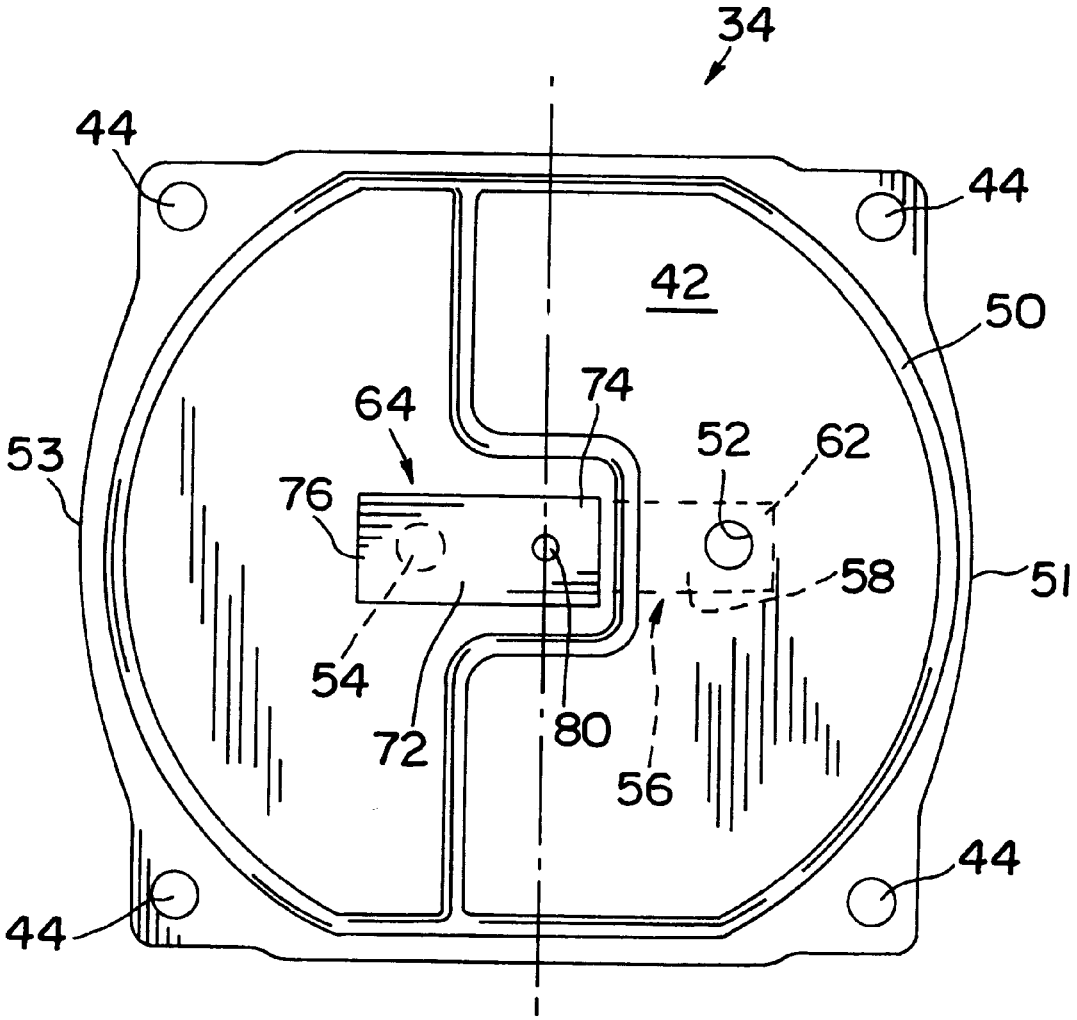
FIG. 7 is a plan view of the valve plate component of the present invention.
Figure 9:
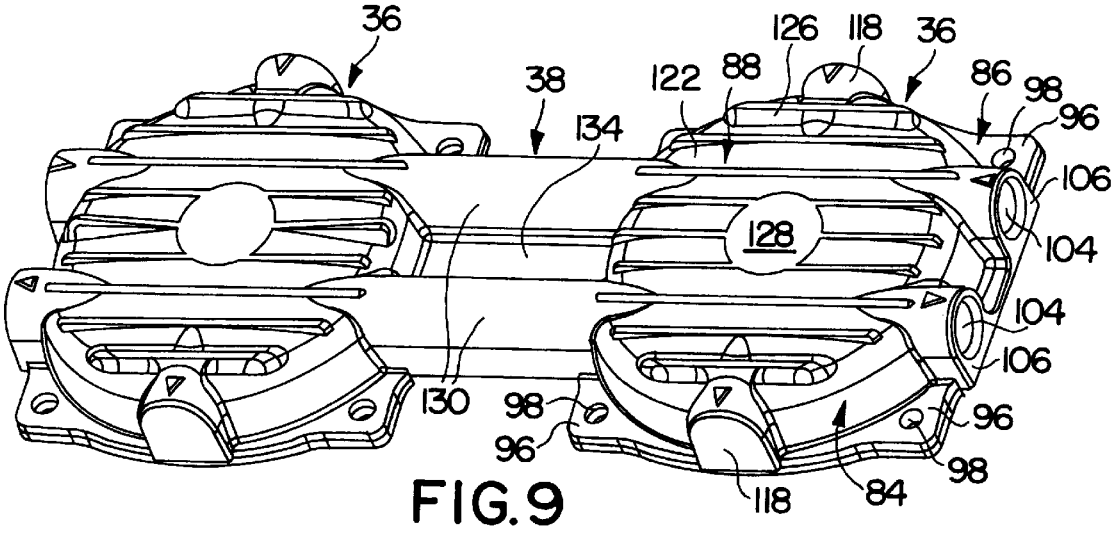
FIG. 9 is another perspective view of a head cover component of the present invention.
Figure 8:
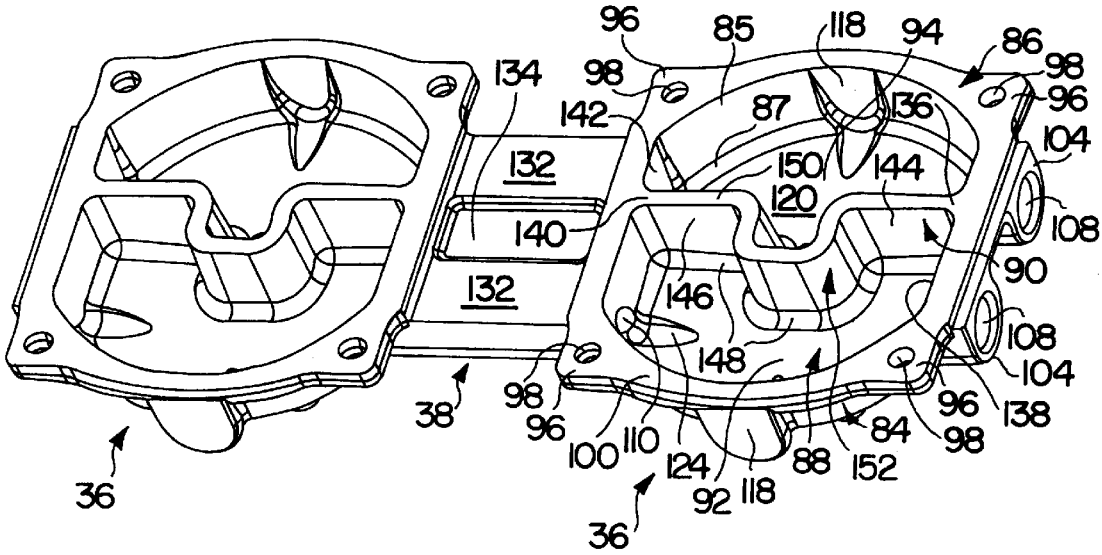
FIG. 8 is a perspective view of a head cover component of the present invention.
Figure 10:
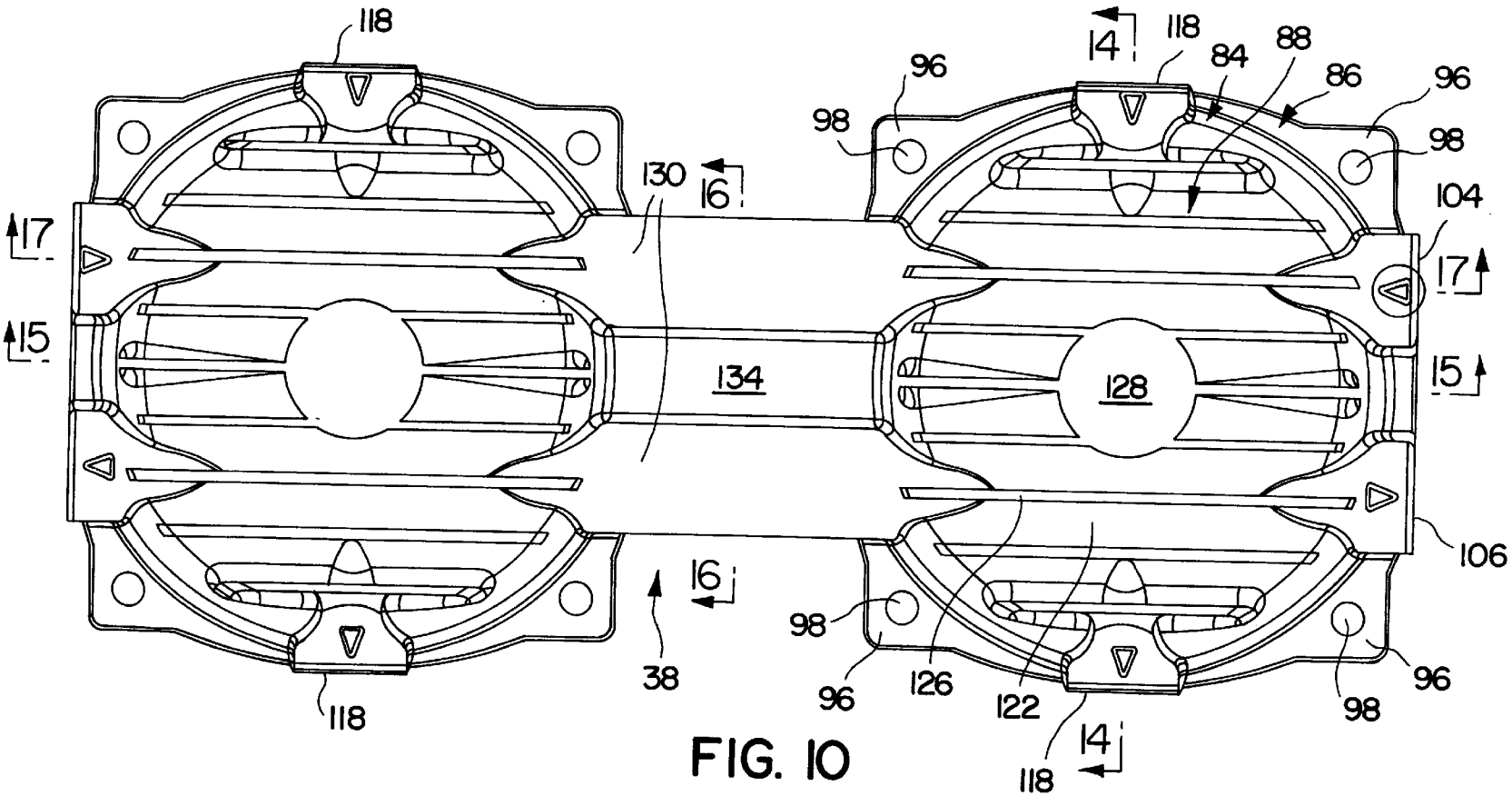
FIG. 10 is a plan view of a head cover component of the present invention.

First valve 56 and second valve 64 are attached to valve plate 34 by fastener 80 adjacent the center of cylinder 16. Fastener 80 is shown as a threaded screw which extends through retainer plate 61, flexible sheet 58, valve plate 34, and flexible sheet 66, and threads into a threaded bore 59 on limiter 72. However, fastener 80 may be of various configurations, for example, a rivet, a nut and bolt combination, or a pair of aligned bolts or screws extending from opposite directions, one through valve 56 and one through valve 64, into valve plate 34. As best shown in FIG. 7, valves 56 and 64 extend from their attachment point at fastener 80 in opposite radial directions. First bore 52, first valve 56, second bore 54, second valve 64, and fastener 80 all lie substantially within the same plane.

Referring now to FIGS. 8–17, it is shown that the head cover component of the present invention generally includes a pair of cylinder covers 36 which are joined together by a center portion 38. As previously mentioned, since both cylinder covers 36 are identical, only one will be described in detail. Each cylinder cover 36 includes a continuous side wall 84, a mounting flange 86 which extends radially outwardly from the lower edge 85 of side wall 84, an upper, enclosure wall 88 which extends between the upper edge 87 of side wall 84, and a divider wall 90 which is disposed within the enclosed volume of side wall 84 and enclosure wall 88. Divider wall 90 divides the enclosed volume into a first, intake volume 92 and a second, exhaust volume 94.

Mounting flange 86 includes four corner portions 96, each having a mounting hole 98 which registers with a corresponding mounting hole 44 in valve plate 34. The lower surface 100 of mounting flange 86, which extends around the perimeter of cylinder cover 36, compressively engages gasket 82 when cover 36 is mounted to valve plate 34. As such, gasket 82 is compressed into groove 50 to provide a perimeter seal between cylinder cover 36 and valve plate 34 as described above.

Figure 17:
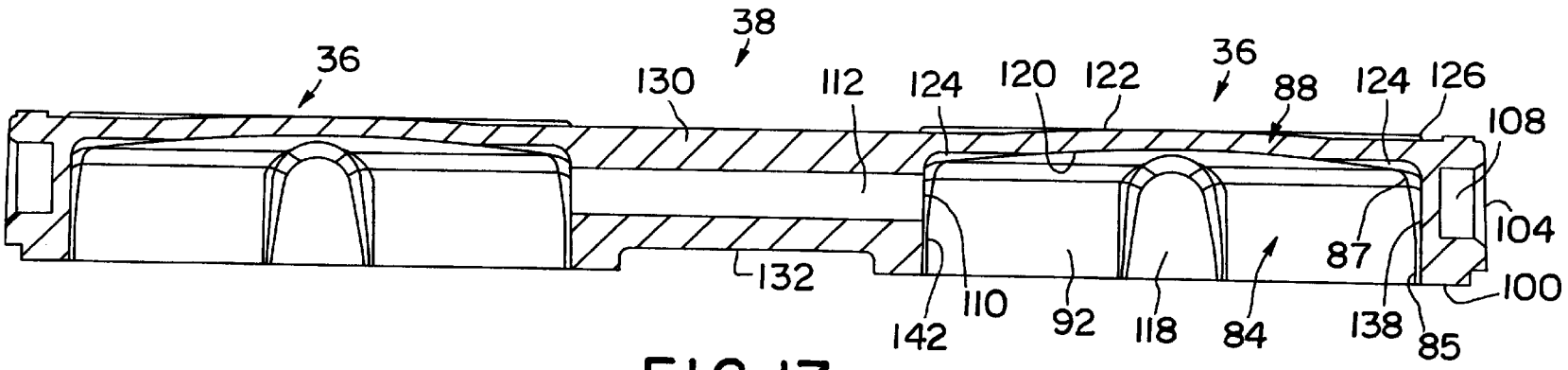
FIG. 17 is a cross-sectional view taken substantially along line D—D of FIG. 10.

Side wall 84 of cylinder head 36 is substantially perpendicular to mounting flange 86, but curves slightly inwardly toward the center of cover 36 with distance from mounting flange 86 as best shown in FIG. 17. Side wall 84 is integrally formed with enclosure wall 88 at a substantially perpendicular intersection, thereby maximizing the interior volume enclosed by cover 36. Integrally formed on flat portion 138 of side wall 84 is a first, inlet port 104 and a second, exhaust port 106. Each port has a substantially cylindrical inner wall 108 with threads formed thereon (not shown). Directly across from first, inlet port 104 formed on flat portion 142 of side wall 84 is a first opening 110 which is in communication with a first passageway 112 extending through center portion 38 into the other cylinder cover 36. Similarly, directly across from second, exhaust port 106 on flat portion 142 is a second opening 114 which is in communication with a second passageway 116 extending through center portion 38 into the other cover 36. Ports 104 and 106 function as receptacles for connection with the external apparatus used in conjunction with compressor 12. Since passageways 112 and 116 communicate the enclosed volumes of covers 36, the operator may connect external apparatus to the ports 104 and 106 of either or both covers 36.

Cover 36 also provides blank ports 118 which are oriented on side wall 84 at right angles from ports 104 and 106. Blank ports 118 may be drilled and tapped to function as alternate receptacles for connection to the external apparatus used in conjunction with compressor 12. Of course, ports 104 and 106 could either remain connected to the external apparatus with auxiliary plumbing or capped off using a threaded plug or insert (not shown).

Figure 15:
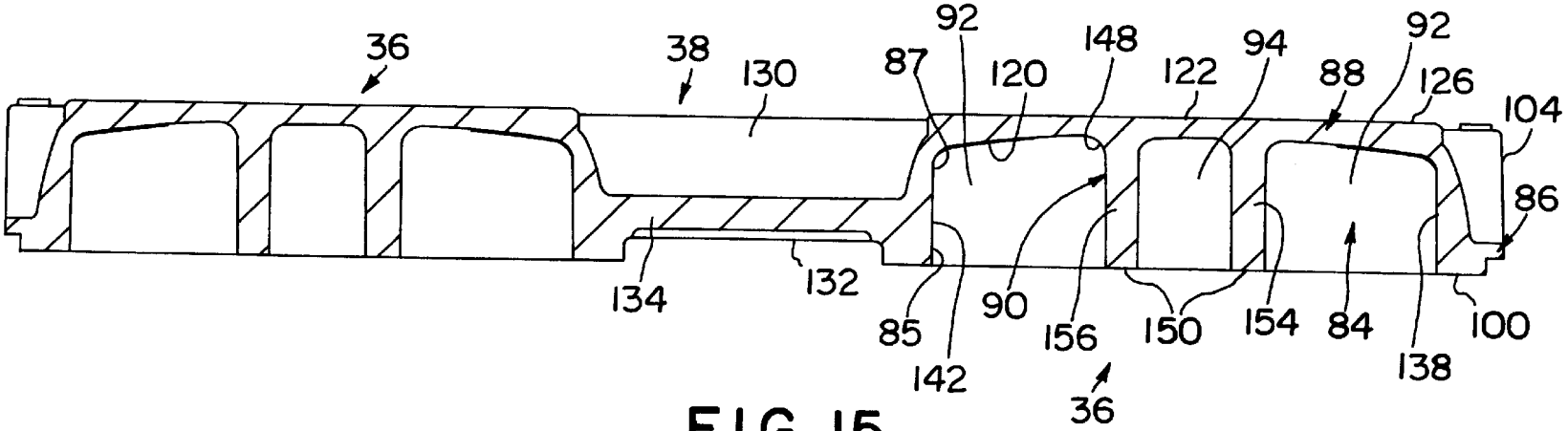
FIG. 15 is a cross-sectional view taken substantially along line B—B of FIG. 10.

Enclosure wall 88 includes an inner surface 120 and an outer surface 122. Inner surface 120 forms a gradual curve or arc between side wall 84, as best shown in FIG. 15, thereby defining a convex upper boundary on the interior space enclosed within cylinder cover 36. A tapered indentation or channel 124 is formed on inner surface 120 adjacent ports 104 and 108, openings 110 and 114, and blank ports 118. Each tapered indentation 124 becomes wider and extends farther into enclosure wall 88 with distance toward side wall 84. Outer surface 122 of enclosure wall 88 includes a plurality of parallel ribs or fins 126 which extend above outer surface 122 by a distance which increases with distance from the center, finless portion 128 of outer surface 122.

Divider wall 90 extends between side wall 84 to divide the enclosed volume of cylinder cover 36 into intake volume 92 and exhaust volume 94 as described above. Upper edge 148 of divider wall 90 is integrally connected to enclosure wall 88. Lower edge 150 of divider wall 90 lies in substantially the same plane as surface 100 of mounting flange 86. Accordingly, as surface 100 engages the outer ring of gasket 82 when cover 36 is mounted to valve plate 34, lower edge 150 of divider wall 90 compresses the portion of gasket 82 extending between the outer ring into groove 50, thereby providing a seal between intake volume 92 and exhaust volume 94.

Figure 11:
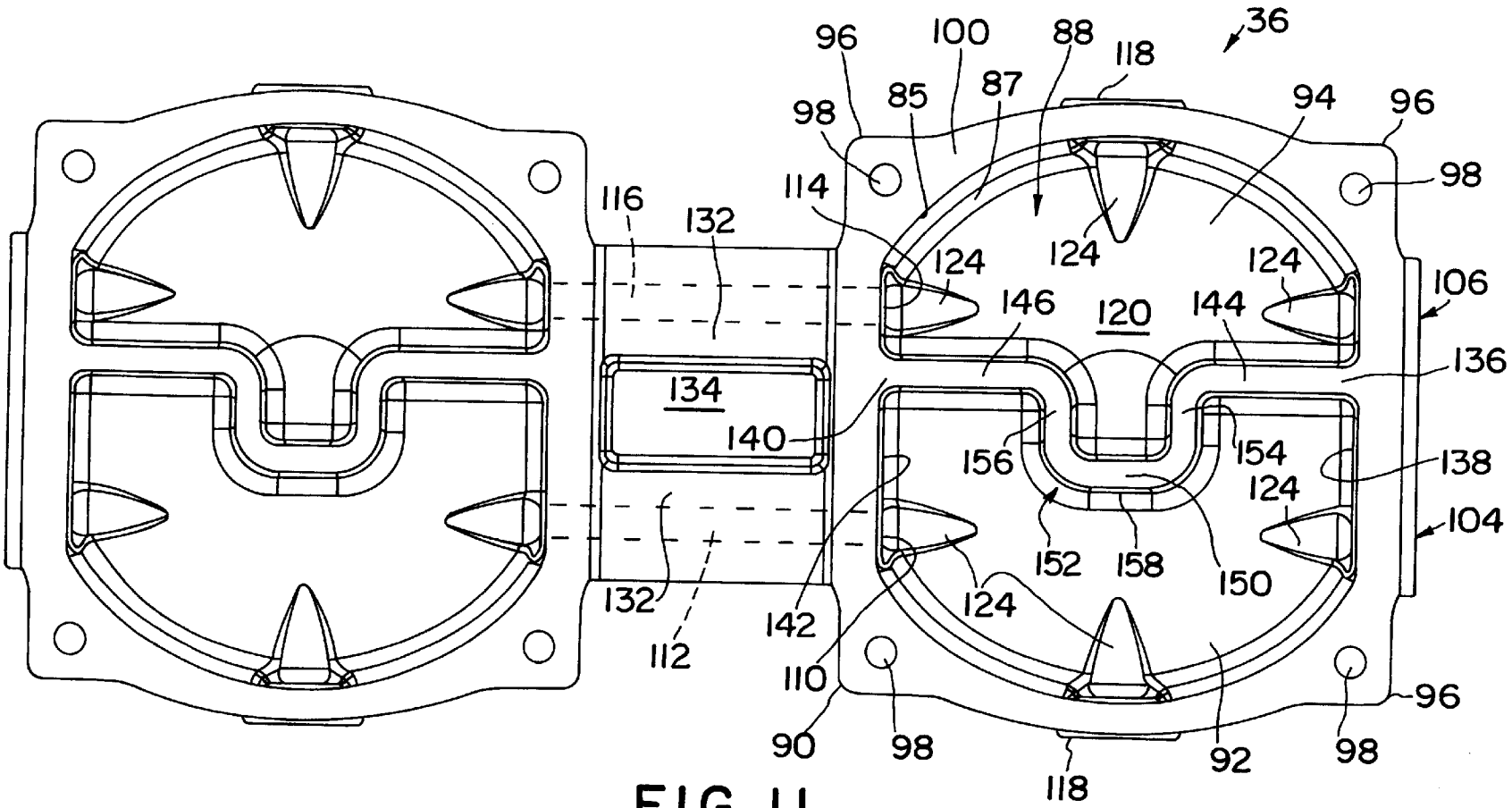
FIG. 11 is another plan view of the head cover component of FIG. 10.
Figure 12:
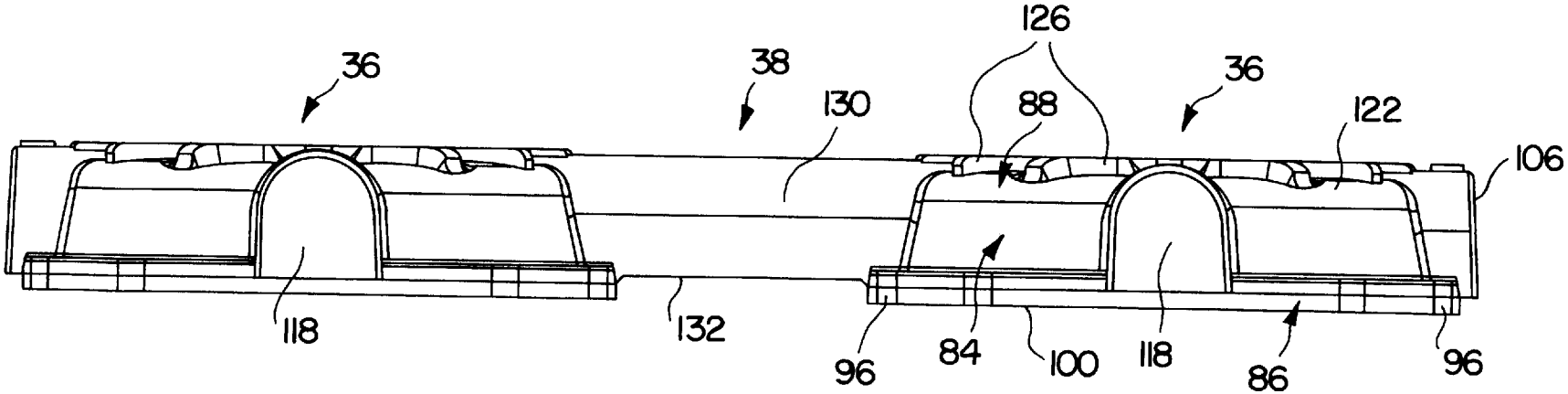
FIG. 12 is a side elevational view of the head cover component of FIG. 10.
Figure 13:
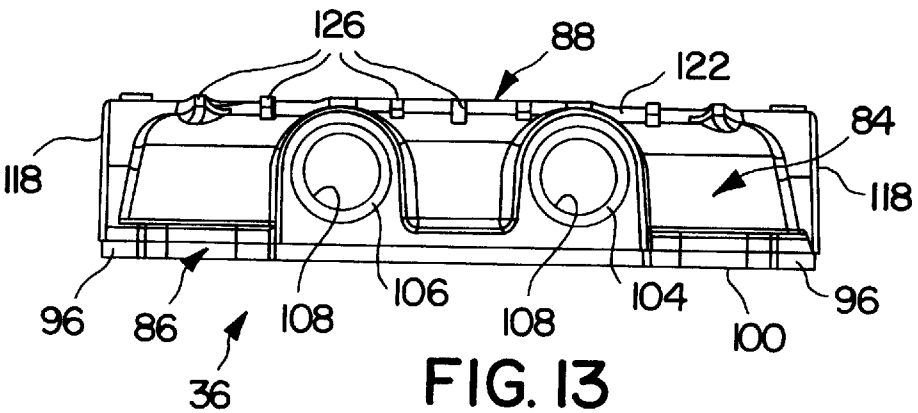
FIG. 13 is another side elevational view of the head cover of FIG. 10.
Figure 14:
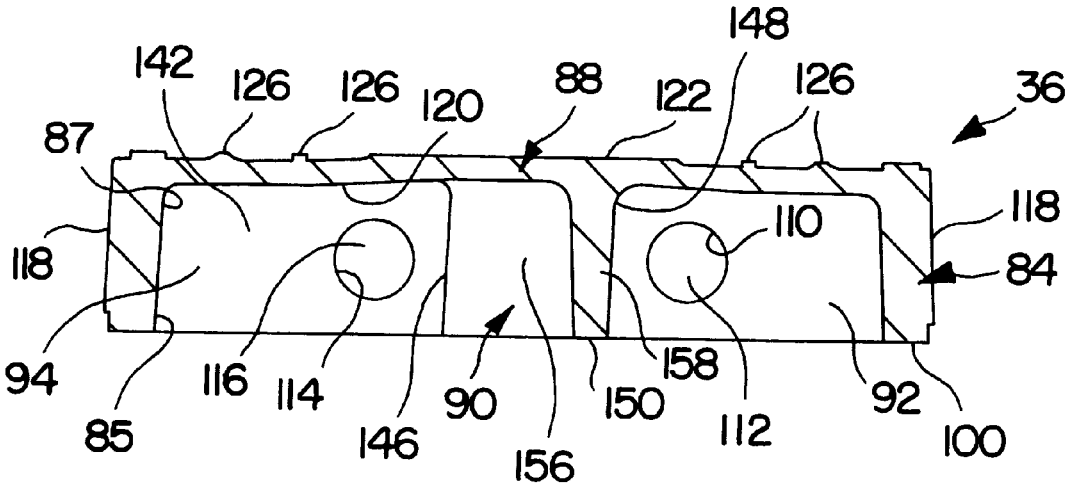
FIG. 14 is a cross-sectional view taken substantially along line A—A of FIG. 10.
Figure 16:
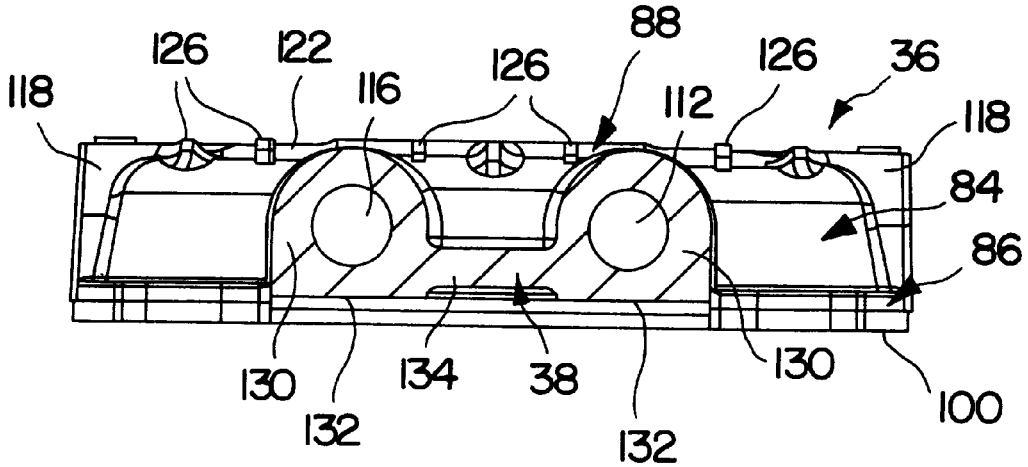
FIG. 16 is a cross-sectional view taken substantially along line C—C of FIG. 10.

Divider wall 90 includes one end 136 connected to flat portion 138 of side wall 84 and another end 140 connected to the opposed, flat portion 142 of side wall 84. A first segment 144 of divider wall 90 extends into the interior space of cylinder cover 36 in perpendicular relationship to flat portion 138 of sidewall 84. A second portion 146 similarly extends perpendicularly from opposed, flat portion 142. As best shown in FIG. 11, first segment 144 and second segment 146 are aligned with one another and parallel to a center line bisecting cylinder cover 36. It should be noted that first segment 144 and second segment 146 are situated as far from this center line as possible without interfering with exhaust port 106 or second opening 114.

Divider wall 90 also includes a curved segment 152 which is substantially U-shaped, having one leg 154 connected and perpendicular to first segment 144, another leg 156 connected and perpendicular to second segment 146, and a connecting segment 158 extending between the legs 154, 156. As shown in FIG. 11, legs 154 and 156 extend perpendicularly across the center line of cylinder cover 36. Connecting segment 158 is parallel to first segment 144 and second segment 146, and is disposed entirely on the opposite side of the center line.

Center portion 38 extends between and connects the two cylinder covers 36. As mentioned, center portion 38 includes first passageway 112 and second passageway 116. The passageways are defined within a pair of tubular members 130. Each tubular member 130 has a flat lower surface 132 which is recessed relative to surfaces 100 of cover mounting flanges 86. A web 134 extends between tubular members 130.

It should be apparent that divider wall 90 is positioned within cylinder cover 36 so that intake volume 92 is maximized. Segments 144 and 146 are located as close as possible to port 106 and opening 114, respectively. Curved portion 152 of divider wall 90, which partially surrounds second valve 64, only departs from the axis defined by segments 144 and 146 to the extent necessary to enclose valve 64 within exhaust volume 94. Thus, divider wall 90 provides an intake volume 92 which is larger than the exhaust volume 94, while accommodating a centrally mounted second valve 64 and avoiding interference with exhaust port 106 and second opening 114.

Additionally, the particular dividing wall 90 depicted in the figures provides an intake volume 92 which is 0.6586 the size of the swept volume of piston 14 divided by the stroke length of piston 14 (in inches). It is generally well known in the art that the larger the intake volume relative to the swept volume, the lower the vibration levels within the compressor. Lower vibration results in less noise. In various compressor applications, such as oxygen concentrators which remain in close proximity to the user during operation, low noise compressors are highly desirable. It is particularly desirable to reduce low frequency noise, since low frequency sound waves propagate most effectively and are readily detected by the human ear. It has been found through experimentation that the divider wall 90 configuration of the present invention, which provides an intake volume 92 of 0.6586 times the swept volume divided by the piston stroke length, provides effective low frequency noise reduction. Clearly, however, one skilled in the art could readily design various divider walls while remaining within these design perimeters.

In operation, the head cover assembly 10 cooperates with piston 14 and cylinder 16 to bring gas into compressor 12 through inlet port 104 and expel the gas through exhaust port 106. As compressor shaft 18 rotates, inner ring 26 and counter weight 28 also rotate. The eccentric relationship between shaft 18 and inner ring 26 results in reciprocating motion of piston 14 within cylinder 16 according to well-known principles in the art. As explained above, piston head 20 tilts relative to first side 40 of valve plate 34 just before and just after piston 14 reaches the top dead center position (see FIGS. 2–4). Thus, the crest of surface 21 at the center of piston head 20 remains farther away from first side 40 of valve plate 34 throughout the stroke of the piston than any other area on the piston. Fastener 80 and retaining plate 61 are advantageously disposed substantially adjacent the center of plate 34, above the center of piston head 20 where the clearance is greatest. Of course, the monitoring location of the valves could be at various locations on valve plate 34, so long as the valve and fastener hardware is sufficiently inset from the inner wall 32 to avoid interference with piston head 20 as it travels through its stroke.

Figure 3:
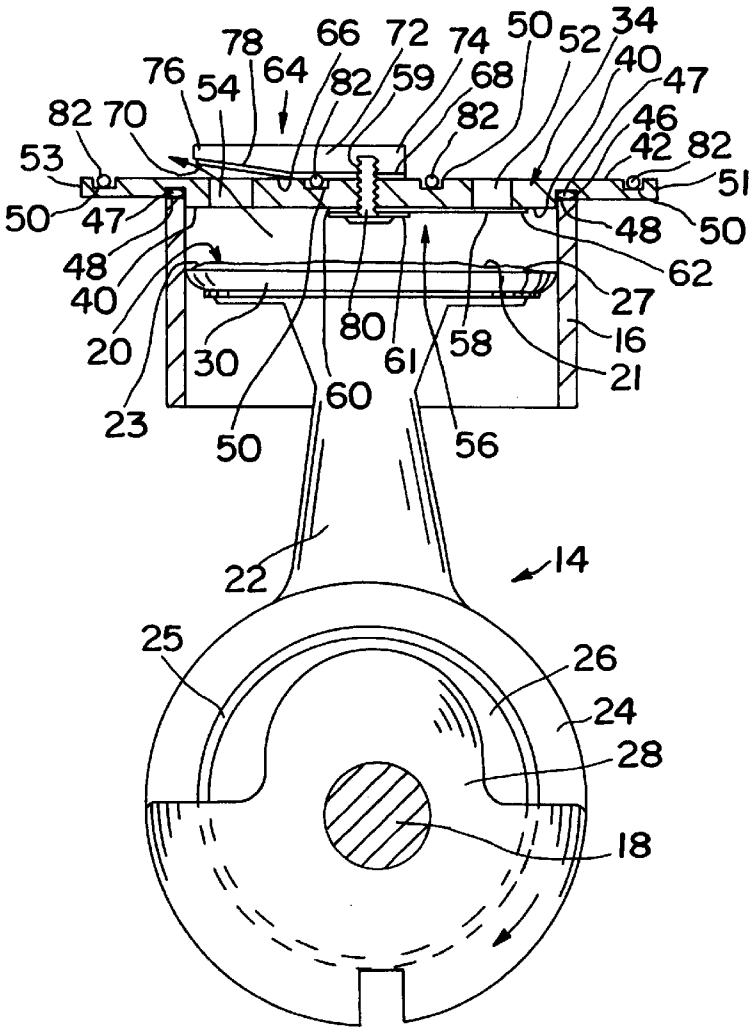
FIGS. 2–5 are side elevational views, partly in section, illustrating the operation of the valve plate component of the present invention.
Figure 4:
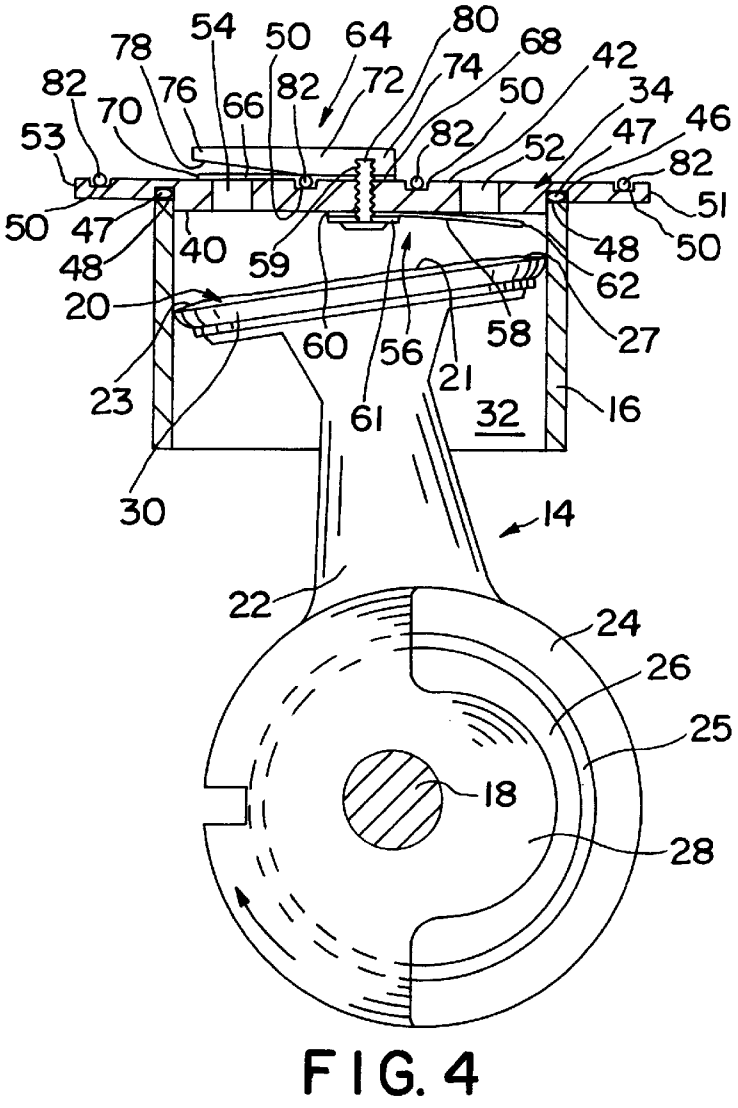

As piston 14 begins its downstroke from the top dead center position (FIG. 3) to the tilted position shown in FIG. 4, the suction created within cylinder 16 causes first valve 56 to begin opening. End 62 of flexible sheet 58 is drawn slightly downwardly away from surface 40 of valve plate 34. of course, the stroke length of piston 14 is designed to avoid interference between first valve 56 and piston head 20. The curved shape of upper surface 21 also provides additional clearance. As piston 14 continues downwardly to its bottom dead center position (FIG. 5), flexible sheet 58 flexes farther from first side 40, permitting the free flow of gas through first bore 52 into cylinder 16.

Figure 2:
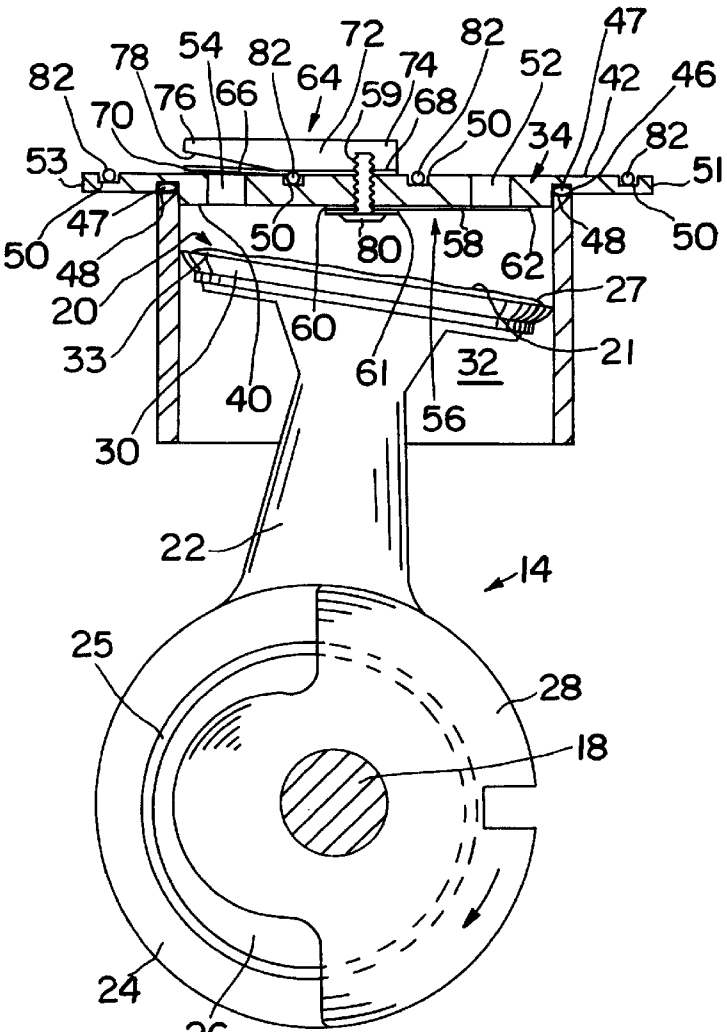
Figure 5:
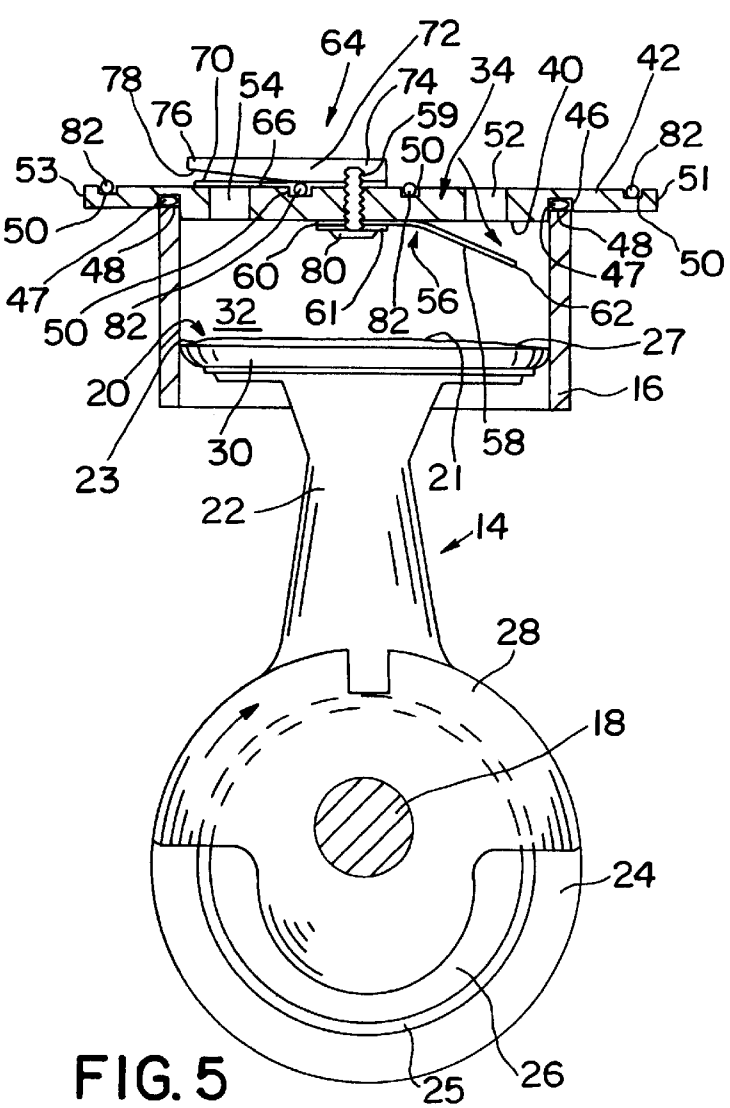

The gas drawn through first bore 52 is drawn from intake volume 92 enclosed within cylinder cover 36. Intake volume 92 of one cover 36 is in communication with intake volume 92 of the other cover 36 through first passageway 112 in tubular member 130. Gas is provided to both intake volumes 92 through inlet ports 104. As piston 14 moves through the bottom dead center position (FIG. 5) toward the tilted position of FIG. 2, the gas in cylinder 16 is compressed, thereby urging first valve 56 to close against first side 40 of valve plate 34 to prevent backflow of the gas into intake volume 92. The upward motion of piston head 20 also opens second valve 64. As shown in FIG. 2, free end 70 of flexible sheet 66 is pushed upwardly away from second side 42 of valve plate 34 as gas is forced from cylinder 16 through second bore 54. As shaft 18 continues to rotate, piston head 20 moves into the top dead center position (FIG. 3) where second valve 64 is fully opened. As shown in FIG. 3, flexible sheet 66 is urged upwardly against surface 78 of limiter 72. Thus, limiter 72 prevents excessive flexing of flexible sheet 66.

The gas forced through second bore 54 passes into exhaust volume 94 within cylinder cover 36. Like intake volumes 92, exhaust volumes 94 of each of the cylinder covers 36 are in communication through second passageway 116 in tubular member 130. The only outlet from the sealed exhaust volumes 94 are exhaust ports 106. Accordingly, as shaft 18 rotates, gas is continuously drawn into compressor 12 through inlet port 104 and continuously expelled from compressor 12 through exhaust port 106.

While this invention has been described as having exemplary embodiments, this application is intended to cover any variations, uses, or adaptions using its general principles. Further, this application is intended to cover such departures from the present disclosure as come within the known or customary practice within the art to which it pertains. The spirit and scope of the invention are to be limited only by the terms of the appended claims.

What is claimed is:

1. A head cover assembly for a compressor having a cylinder, comprising:

a plate having a first side for mounting adjacent the compressor cylinder and a second side;

a valve mounted to the second side of the plate;

a side wall being substantially perpendicular to the plate and extending adjacent the perimeter of the plate;

an enclosure wall extending parallel to the plate between the side wall thereby enclosing a volume; and a divider wall extending between the side wall through the enclosed volume, the divider wall defining a first volume and a second volume including the valve, the first volume being larger than the second volume the divider wall extending between the side wall substantially adjacent a center line bisecting the head cover assembly, at least one portion of the divider wall being disposed on one side of the center line, and at least one other portion of the divider wall being disposed on the other side of the center line.

2. A head cover assembly as claimed in claim 1 wherein the divider wall includes a first segment disposed on the one side of the center line extending parallel to the centerline from a first location on the side wall, a second segment disposed on the one side of the center line extending parallel to the center line from a second location on the side wall spaced apart from the first location, and a curved segment connecting the first segment and the second segment, a portion of the curved segment being disposed on the other side of the center line.

3. A head cover assembly as claimed in claim 2 wherein the first segment is aligned with the second segment.

4. A head cover assembly as claimed in claim 2 wherein the majority of the first volume is on the other side of the center line and a majority of the second volume is on the one side of the center line.

5. A head cover assembly for a compressor having a cylinder, comprising:

a plate having a first side for mounting adjacent the compressor cylinder and a second side;

a valve mounted to the second side of the plate;

a side wall being substantially perpendicular to the plate and extending adjacent the perimeter of the plate;

an enclosure wall extending parallel to the plate between the side wall thereby enclosing a volume; and a divider wall extending between the side wall through the enclosed volume, the divider wall defining a first volume and a second volume including the valve, the first volume being larger than the second volume;

the compressor cylinder housing a piston having a head which reciprocates within the cylinder a stroke length between a top dead-center position and a bottom dead-center position, an upper surface on the piston head and the cylinder defining a swept volume bounded by the cylinder, the piston head upper surface at the top dead-center position, and the piston upper surface at the bottom dead-center position, the first volume of the enclosed volume being equal to 0.6586 times the swept volume divided by the piston stroke length.

6. A head cover assembly for a compressor, comprising:

a plate having a first side, a second side, a first bore, and a second bore;

a first valve having one end connected to the first side of the plate and another end adjacent the first bore;

a second valve having one end connected to the second side of the plate in alignment with the one end of the first valve, and another end adjacent the second bore; and a cover removably secured to the plate including a continuous side wall having a first edge for engaging the second side of the plate, the side wall surrounding the first and second bores, an enclosure wall extending between a second edge of the side wall enclosing a volume bounded by the plate, the cover side wall, and the cover enclosure wall, and a divider wall having a first edge adjacent the second side of the plate and a second edge connected to the cover enclosure wall, the divider wall extending between the side wall though the enclosed volume thereby defining a first volume including the first bore and a second volume including the second valve and the second bore, the first volume being larger than the second volume;

the divider wall extends between the side wall substantially adjacent to a center line by bisecting the cover, at least one portion of the divider wall being disposed on one side of the center line, and at least one other portion of the divider wall being disposed on the other side of the center line.

7. A head cover assembly as claimed in claim 6 wherein the divider wall includes a first segment disposed on the one side of the center line extending parallel to the center line from a first location on the side wall, a second segment disposed on the one side of the center line extending parallel to the center line from a second location on the side wall spaced apart from the first location, and a curved segment connecting the first and the second segments, a portion of the curved segment being disposed on the other side of the center line.

8. A head cover assembly as claimed in claim 7 wherein the first and second segments of the divider wall lie substantially within the same claim.

9. A head cover assembly as claimed in claim 6 wherein the majority of the first volume is on the other side of the center line and the majority of the second volume is on the one side of the center line.

10. A head cover assembly as claimed in claim 1 further comprising a fastener extending through the one end of the first valve, the plate, and the one end of the second valve.

11. A head cover assembly as claimed in claim 1 wherein the plate includes a first groove on the first side for alignment with a compressor cylinder.

12. A head cover assembly as claimed in claim 1 further comprising a gasket disposed between the second side of the plate and the first edges of the cover side wall and divider wall.

13. A head cover assembly as claimed in claim 12 wherein the second side of the plate includes a second groove for receiving the gasket.

14. A head cover assembly as claimed in claim 1 wherein the first bore and the second bore are substantially equally spaced radially from a center point on the plate.

15. A head cover assembly as claimed in claim 1 wherein the first bore and the second bore extend perpendicularly through the plate relative to the first side of the plate.

16. A head cover assembly as claimed in claim 1 wherein the first valve includes a flexible sheet extending across the first bore and the second valve includes a flexible sheet extending across the second bore.

17. A head cover assembly as claimed in claim 16 wherein the second valve includes a limiter extending from the one end of the second valve across the second bore, the limiter including a surface for engaging the flexible sheet.

18. A head cover assembly as claimed in claim 10 wherein the first bore, the second bore, and the fastener lie substantially within the same plane.

19. A head cover assembly as claimed in claim 10 wherein the fastener extends through the plate at a location substantially centered on the plate.

20. A head cover assembly as claimed in claim 1 wherein the cover side wall includes a first port in communication with the first volume and a second port in communication with the second volume.

21. A head cover assembly as claimed in claim 1 wherein the divider wall includes a curved segment partially surrounding the second valve.

22. A head cover assembly for a compressor, comprising:

a plate having a first side, a second side, a first bore, and a second bore;

a first valve having one end connected to the first side of the plate and another end adjacent the first bore;

a second valve having one end connected to the second side of the plate in alignment with the one end of the first valve, and another end adjacent the second bore; and a cover removably secured to the plate including a continuous side wall having a first edge for engaging the second side of the plate, the side wall surrounding the first and second bores, an enclosure wall extending between a second edge of the side wall enclosing a volume bounded by the plate, the cover side wall, and the cover enclosure wall, and a divider wall having a first edge adjacent the second side of the plate and a second edge connected to the cover enclosure wall, the divider wall extending between the side wall through the enclosed volume thereby defining a first volume including the first bore and a second volume including the second valve and the second bore, the first volume being larger than the second volume;

the compressor including a cylinder housing a piston having a head which reciprocates within the cylinder a stroke length between a top dead center position and a bottom dead center position, an upper surface on the piston head and the cylinder defining a swept volume bounded by the cylinder, the piston head upper surface at the top dead center position, and the piston head upper surface at the bottom dead center position, an upper surface on the piston head and the cylinder defining a swept volume bounded by the cylinder, the piston head upper surface at the top dead center position, and the piston head upper surface at the bottom dead center position, the first volume of the enclosed volume being equal to 0.6586 times the swept volume divided the piston stroke length.

23. A head cover assembly for a compressor having a cylinder, comprising:

a plate having a first side for mounting adjacent the compressor cylinder and a second side;

a valve mounted to the second side of the plate;

a side wall being substantially perpendicular to the plate and extending adjacent the perimeter of the plate;

an enclosure wall extending parallel to the plate between the side wall thereby enclosing a volume; and a divider wall extending between the side wall through the enclosed volume, the divider wall defining a first volume and a second volume including the valve, the first volume being larger than the second volume, a valve mounted to the second side of the plate;

a side wall being substantially perpendicular to the plate and extending adjacent the perimeter of the plate;

an enclosure wall extending parallel to the plate between the side wall thereby enclosing a volume; and a divider wall extending between the side wall through the enclosed volume, the divider wall defining a first volume and a second volume including the valve, the first volume being larger than the second volume;

the divider wall having a curved segment partially surrounding the valve and a pair of aligned segments extending between the curved segment and the side wall.

24. A head cover assembly as claimed in claim 23 wherein the curved segment is substantially U-shaped having a first leg connected to one of the aligned segments and a second leg connected to the other of the aligned segments.

25. A head cover assembly for a compressor having at least two cylinders, comprising:

a first valve plate for mounting to one cylinder having a pair of valves disposed on the first valve plate substantially adjacent the center of the cylinder;

a second valve plate for mounting to another cylinder having a pair of valves disposed on the second valve plate substantially adjacent the center of the cylinder;

a head cover including a first cylinder cover for mating with the first valve plate, a second cylinder cover for mating with the second valve plate, and a center portion connecting the first cylinder cover to the second cylinder cover, each of the first and the second cylinder covers including a divider wall defining a first enclosed volume within the cylinder cover and a second enclosed volume within the cover.

26. A head cover assembly as claimed in claim 25 wherein the second enclosed volume of each of the first and the second cylinder covers encloses one valve of the pair of valves.

27. A head cover assembly as claimed in claim 25 wherein the first volume of the first cylinder cover communicates with the first volume of the second cylinder cover through a first passageway defined within the head cover center portion, and the second volume of the first cylinder cover communicates with the second volume of the second cylinder cover through a second passageway defined within the head cover center portion.

28. A cylinder cover for a compressor, comprising:

a continuous side wall having a first edge for mating with the compressor;

an enclosure wall extending between a second edge of the side wall thereby defining an interior space within the cylinder cover;

a divider wall extending between the side wall within the interior space substantially adjacent a center line bisecting the cylinder cover, the divider wall having a first segment disposed on the one side of the center line extending parallel to the center line from a first location on the side wall, a second segment disposed on the one side of the center line extending parallel to the center line from a second location on the side wall spaced apart from the first location, and a curved segment connecting the first and second segments, a portion of the curved segment being disposed on the other side of the center line.

29. A cylinder cover as claimed in claim 28 wherein the first segment is aligned with the second segment and lying substantially in the same plane.

30. A cylinder cover as claimed in claim 28 wherein the divider wall divides the interior space into a first volume and a second volume, a majority of the first volume being disposed on the other side of the center line and a majority of the second volume being disposed on the one side of the center line, the first volume being larger than the second volume.

* * * * *